United States Patent [19]

Lam et al.

[11] 4,383,253

[45] May 10, 1983

[54] IONIZATION SMOKE DETECTOR

[75] Inventors: Hau C. Lam; Thomas K. P. Lee, both of Kowloon, Hong Kong

[73] Assignee: International Quartz Ltd., Kowloon, Hong Kong

[21] Appl. No.: 7,440

[22] Filed: Jan. 29, 1979

[51] Int. Cl.[3] ..... G08B 17/10

[52] U.S. Cl. ..... 340/629; 250/381; 313/54

[58] Field of Search ..... 340/627, 628, 629, 630; 250/381, 382, 384, 385; 313/54

[56] References Cited

U.S. PATENT DOCUMENTS

| | | | |
|---|---|---|---|
| 3,795,904 | 3/1974 | Beyersdorf et al. | 340/629 |
| 3,946,374 | 3/1976 | McMillian et al. | 340/629 |
| 4,150,373 | 4/1979 | Ried, Jr. | 340/629 |

FOREIGN PATENT DOCUMENTS

| | | | |
|---|---|---|---|
| 2546970 | 4/1977 | Fed. Rep. of Germany | 340/629 |

*Primary Examiner*—John W. Caldwell, Sr.
*Assistant Examiner*—Daniel Myer
*Attorney, Agent, or Firm*—Thomas R. Vigil

[57] ABSTRACT

The detector comprises a first electrode defined by a bolt mounted on an annular insulator which in turn is mounted on a printed circuit board and a second electrode defined by a cup shaped member which is aligned with the bolt and positioned with the interior thereof facing and being spaced from the bolt. A source of radiation is mounted on the head of the bolt and a third electrode is spaced outwardly from and laterally to one side of the head of the bolt. A box-shaped electrostatic shield is fixed to the printed circuit board and has an opening in which is positioned the cup shaped member. The shield serves to enclose the space between the rim of the cup shaped member and the printed circuit board. An annular insulator is mounted on and about the bolt. The third electrode has a rectangular base portion mounted on the annular insulator and a rectangular plate portion which extends outwardly from the base portion and which lies in a plane which is parallel spaced from the axis of the bolt forming the first electrode. The sidewalls of the cup shaped member have portions thereof punched inwardly to provide inlets for ambient air into the space within the cup shaped member and between the cup shaped member and the bolt.

9 Claims, 5 Drawing Figures

IONIZATION SMOKE DETECTOR

BACKGROUND OF THE INVENTION

1. Field of the Invention

The field of the invention is ionization smoke detectors. More particularly, the field of the invention is ionization smoke detectors utilizing a single ionization source.

2. Description of the Prior Art

Heretofore various configurations for ionization smoke detector chambers utilizing a single radioactive source have been proposed. Examples of such ionization smoke detectors can be found in the following U.S. patents:

| U.S. Pat. No. | PATENTEE |
|---|---|
| 3,560,737 | Skildum |
| 3,935,465 | Beyersdorf |
| 3,935,492 | Sasaki et al. |
| 4,012,729 | Weaver et al. |
| 4,044,262 | Minowa |
| 4,044,263 | Ried, Jr., et al. |
| 4,093,886 | Blackwell |

The detector disclosed in U.S. Pat. No. 3,560,737 utilizes an anode carrying a radioactive source which is surrounded by a cup shaped second electrode which in turn is surrounded by a cup shaped third electrode. Windows are provided in the second electrode for permitting ionization currents between the anode and the third electrode.

In U.S. Pat. No. 4,044,262 there is disclosed a first electrode having a radioactive source mounted on the end thereof, a second cup shaped electrode surrounding said first electrode and having an opening in the center thereof concentric with said first electrode and a third cup shaped electrode positioned about and coaxial with the second electrode.

U.S. Pat. No. 3,935,492 discloses a smoke detector having a first electrode, a metallic screen surrounding said first electrode and forming a second electrode and a larger metallic screen surrounding the smaller screen and having a radioactive source therein which irradiates the space within the larger screen and the space within the smaller screen in which is mounted the first electrode.

In U.S. Pat. Nos. 4,012,729 and 4,093,886 there is illustrated a detector having a cylindrical metallic housing forming one electrode, an electrode mounted on an insulator at one end of the housing and having an ion particle source situated thereon and a ring electrode spaced slightly above and coaxial with the end electrode having the ion particle source. The opening in the center of the ring electrode is coaxial with the radioactive source.

U.S. Pat. No. 4,044,263 discloses a detector including a first button shaped electrode mounted on an insulator within a housing which defines a second electrode. A signal electrode extends axially on the axis of the housing and of the second electrode and is separated from the first electrode by a relatively small distance and has a bent laterally extending portion.

U.S. Pat. No. 3,935,465 discloses a smoke detector with a cup shaped housing that has a depressed center wall and an arrangement of inlet openings into a smoke detection chamber which provides for diffusion of high velocity air currents impinging upon the cup shaped housing. This configuration provides for the entrance of ambient air in a radial direction into the housing.

As will be described in greater detail hereinafter, the ionization smoke detector of the present invention differs from the previously proposed smoke detectors described above by providing for a sensing electrode in a smoke detector chamber which is spaced axially from and laterally to one side of a first electrode mounting a radioactive source. Also, the ionization smoke detector of the present invention provides a second cup shaped electrode which is spaced from the first electrode and which has portions of the peripheral sidewall of the cup shaped second electrode punched in to form inlets which provide for the entrance of ambient air in a circumferential direction into the interior space within the cup shaped second electrode.

SUMMARY OF THE INVENTION

According to the invention there is provided an ionization smoke detector comprising a first electrode having a head at the end thereof and a central axis, a source of radiation mounted on said head at the end of said first electrode, a metallic cup shaped member having a central axis aligned with and coaxial with the central axis of said first electrode and positioned with the interior thereof facing and being spaced from said first electrode, said cup shaped member defining a second electrode and having passage means through the walls thereof for admitting ambient air into the space defined within said cup shaped member and between said cup shaped member and said first electrode, a third electrode spaced axially outwardly from said head of said first electrode and laterally to one side of, or radially of, said central axis of said head of said first electrode, said first, second and third electrodes being adapted for connection to a smoke detector circuit and said radioactive source providing a predetermined ion current flow between said first electrode and said second electrode to establish a predetermined voltage potential at said third electrode, and the voltage potential at said third electrode being changed by the presence of smoke in said space with such change in potential being sensed by the smoke detector circuit for causing an alarm to be sounded.

DESCRIPTION OF THE PREFERRED EMBODIMENT

Figure 1:
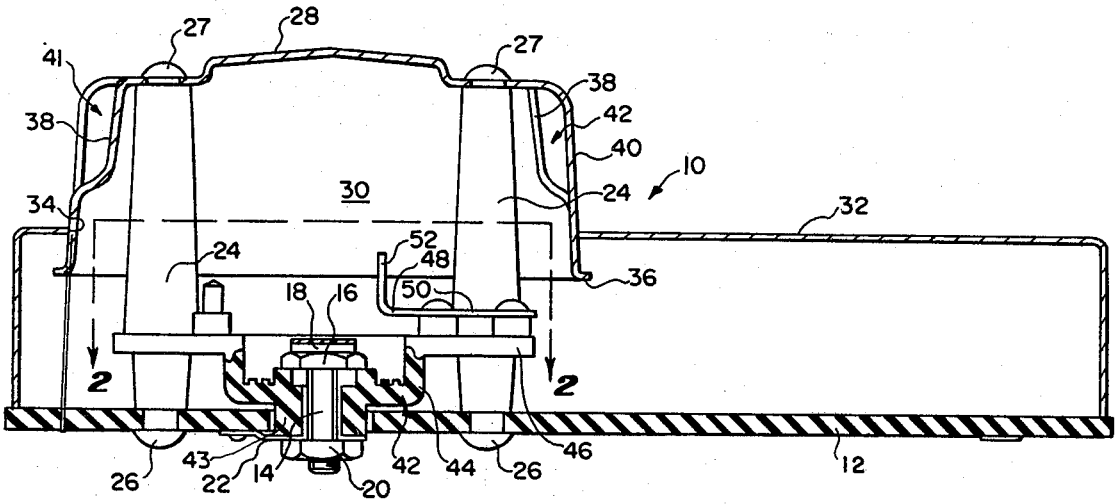
FIG. 1 is a vertical sectional view through the ionization smoke detector of the present invention.

Referring now to the drawings in greater detail, there is illustrated in FIG. 1 an ionization smoke detector 10 constructed in accordance with the teachings of the present invention. The smoke detector 10 includes a printed circuit board 12 forming a base plate for the smoke detector 10. Positioned adjacent to the circuit board 12 is a bolt 14 which forms a first electrode and which has a head 16 on which is mounted a radioactive source 18 which is preferably 0.7 μCi. As shown, the bolt 14 is held by a nut 20 against a metallic contact 22 on the outside of the circuit board 12.

Also mounted to the circuit board are three insulating members 24 which are fixed by fasteners 26 such as rivets or screws at one end to the printed circuit board 12 and by fasteners 27 at the other end to a metallic cup shaped second electrode 28. As shown, the insulating members 24 serve as spacers for spacing the cup shaped second electrode 28 from the first electrode 14.

In the illustrated embodiment, the cup shaped second electrode 28 is aligned coaxially with the first electrode 14 with the space within the cup shaped electrode 28 facing the first electrode 14. The space defined between the first and second electrodes forms and defines an ionization chamber 30 of the smoke detector 10.

This chamber or space 30 is further enclosed by a box-shaped electrostatic shield 32 which extends upwardly from the printed circuit board and which has an opening 34 therein within which the cup shaped second electrode 28 is received. As shown, rim 36 of the cup shaped electrode 28 is spaced from the printed circuit board 12.

Portions, such as portion 38 of the circumferential peripheral sidewall 40 of the cup shaped second electrode 28 are punched in so as to provide inlets 41 which allow ambient air impinging upon the smoke detector to be deflected into and enter into the space 30 in a circumferential or circular direction relative to the cup shaped second electrode 28. In this way, the ionized atmosphere within the ionization chamber 30 is not adversely affected by winds and drafts of the ambient air impinging upon the outer surface of the smoke detector 10.

Figure 2:
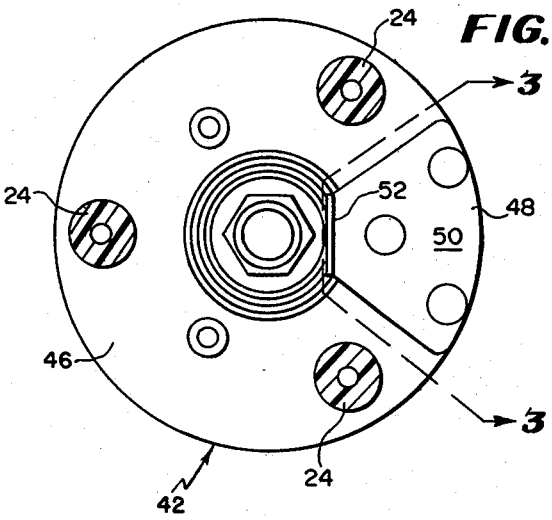
FIG. 2 is a sectional view taken along line 2—2 of FIG. 1.
Figure 3:
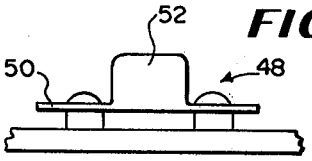
FIG. 3 is an end view of a sensing electrode of the smoke detector and is taken along line 3—3 of FIG. 2.

As shown in FIG. 1, an annular insulator 42 has a central hub 43 received on and about the bolt 14. The hub 43 is fixed to the printed circuit board such as by heat welding. Connected to the hub 43 by a web 44 is a flat annular ring portion 46. On the ring portion 46, above and to one side of the xis of the head 16 of the first electrode 14, is situated a third or sensing electrode 48 which has a base portion 50 mounted to the ring portion 46 of the annular insulator and an upright rectangular plate portion 52 which forms the electrode surface of the sensing electrode 48. The plate portion 52 of the sensing electrode 48 lies in a plane which is parallel spaced from the axis of the bolt 14 as shown in FIGS. 1 and 2.

With reference to the construction of the smoke detector 10 of the present invention described above, it will be noted that the box-shaped electrostatic shield 32 not only provides a shield for the printed circuit on the outer surface of the printed circuit board 12 but also encloses the space between the rim 36 of the cup shaped second electrode 28 and the printed circuit board mounting the first electrode 14. In other words, the electrostatic shield 32 forms part of a housing for defining or enclosing the ionization chamber 30.

Additionally, it will be appreciated that the forming of the inlets 41 by punching in portions 38 of the circumferential peripheral sidewall 40 of the cup shaped second electrode 28 minimizes the effect of air currents (that may exist in a fire) on the charged atmosphere within the chamber 30. In this respect, the air currents will enter circumferentially into the cup shaped second electrode.

Figure 5:
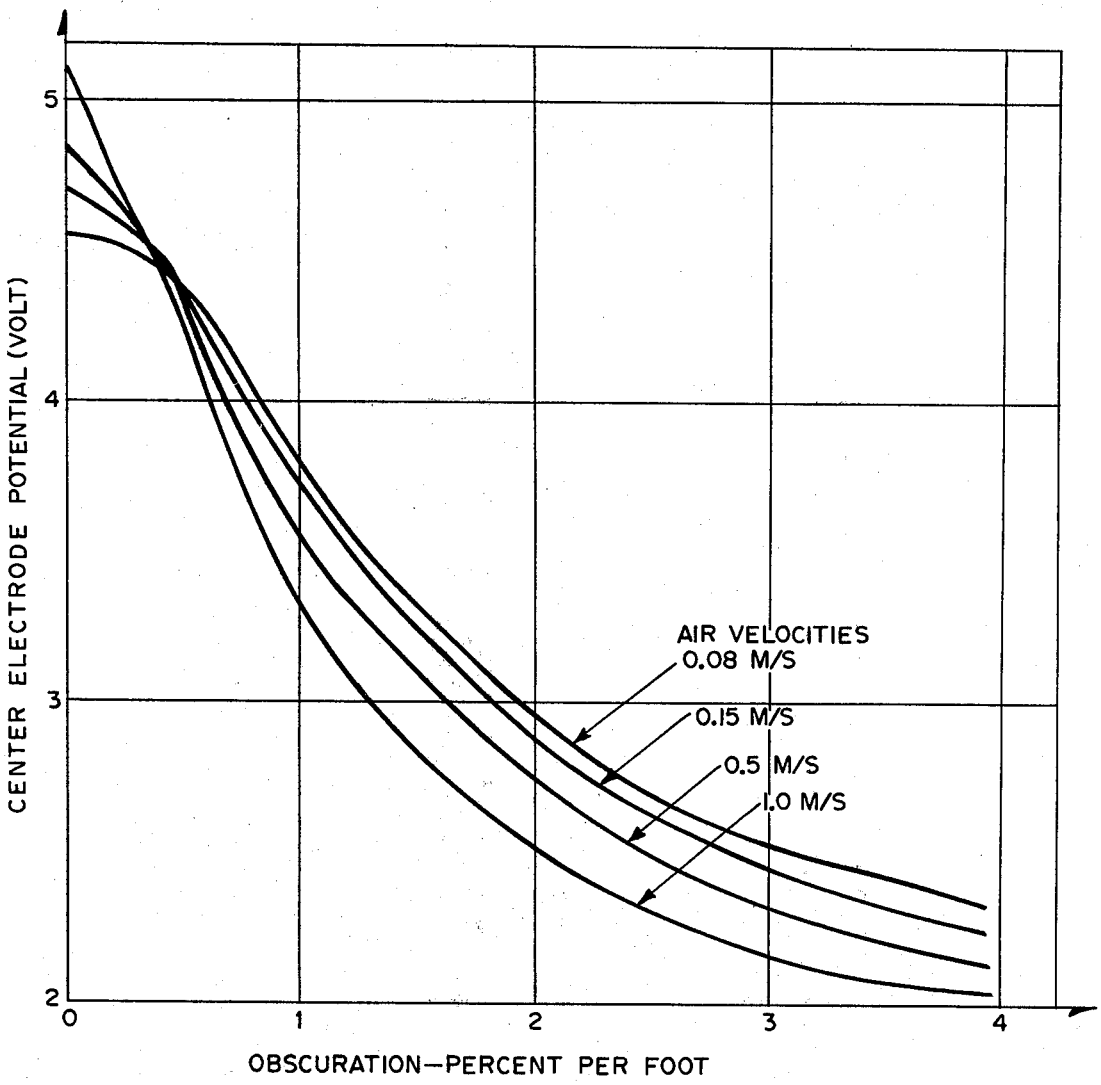
FIG. 5 is a graph of the variations in potential on the sensing electrode relative to the percent of obscuration per foot due to the presence of smoke for different air velocities impinging on the smoke detector.

The minimizing of the effect of air velocity is reflected in the graphs of the change of voltage potential on the sensing electrode 48 versus percent obscuration per foot when different air velocities containing smoke impinge upon the ionization smoke detector 10 as shown in FIG. 5.

Also, the construction of the ionization smoke detector 10 permits the sensing electrode 48 to be mounted close to the printed circuit board to reduce noise problems and leakage current problems. Moreover, the rectangular plate portion 52 of the sensing electrode 48 provides an adequate electrode surface for sensing the voltage at that point within the ionization chamber 30.

Figure 4:
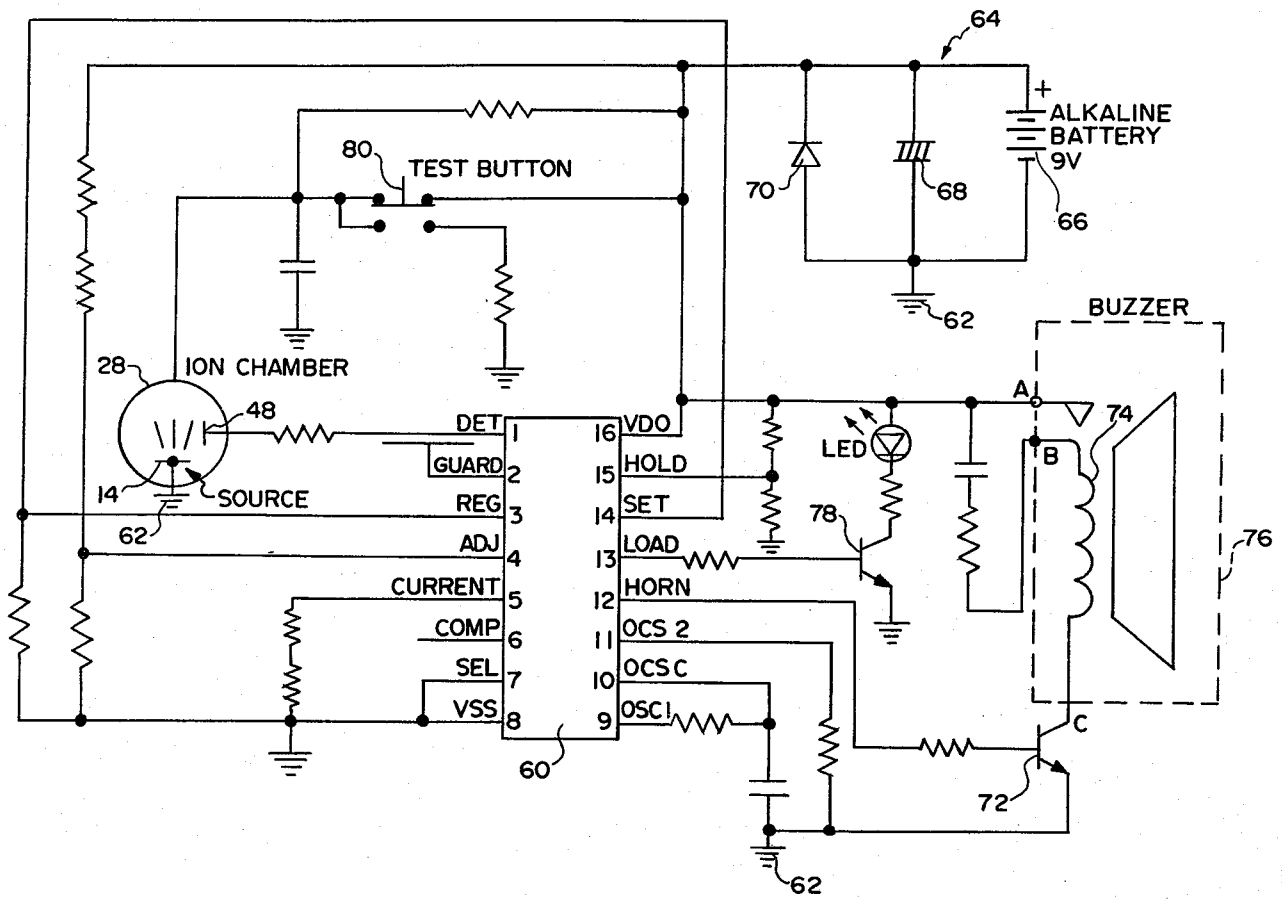
FIG. 4 is a schematic circuit diagram of the smoke detector circuit used with the smoke detector of the present invention.

Referring now to FIG. 4 there is illustrated therein a schematic circuit diagram for the electrical circuit of the ionization smoke detector 10 of the present invention. As shown, the electrical circuit for the smoke detector utilizes a conventional smoke detector circuit 60 which is sold by Motorola, Inc. of Austin, Tex. under Part No. MC14462. As shown, the first electrode 14 is connected to system ground 62 for the circuit. The second electrode 28 is connected to the D.C. supply voltage pin 16 of the smoke detector circuit 60 and the sensing electrode 48 is connected to the detector pin 1 of the smoke detector circuit 60. Also connected to the D.C. supply voltage pin 16 is a power supply 64 comprising a 9 volt alkaline battery 66, a 330 microfarad capacitor 68 and a diode 70, all of which are connected in parallel between system ground 62 and pin 16. The pin 12 which is the horn actuating signal pin is connected to a control transistor 72 which has its collector connected in series with coil 74 of a buzzer 76. Also, a battery test output pin 13 of the smoke detector circuit 60 is connected to the base of a transistor 78 which has its collector connected to a light emitting diode which is also connected to the supply voltage pin 16. Also, a test button 80 is provided as shown.

In the operation of the smoke detector 10, the presence of smoke within the ionization chamber 30 will cause a drop in the voltage potential on the sensing electrode 48 as the charged ions in the chamber are absorbed by the smoke particles. This drop in voltage is sensed by the smoke detector circuit 60 and causes the buzzer 76 to operate after a predetermined voltage drop from the steady state condition has occurred.

As shown in FIG. 5, the voltage drops that are encountered at different air velocities containing smoke impinging upon the smoke detector 10 varies only slightly from a velocity of 0.08 meters/second to a velocity of 1 meter/second.

From the foregoing description it will be apparent that the smoke detector 10 of the present invention has a number of advantages some of which have been described above and others of which are inherent in the invention. Accordingly, the scope of the invention is only to be limited as necessitated by the accompanying claims.

We claim:

1. An ionization smoke detector comprising a first electrode having a head at the end thereof and a central axis, a source of radiation mounted on said head at the end of said first electrode, a metallic cup shaped member having a central axis aligned with and coaxial with said central axis of said first electrode and positioned with the interior thereof facing and being spaced from said first electrode, said cup shaped member defining a second electrode and having passage means through the walls thereof for admitting ambient air into the space defined within said cup shaped member and between said cup shaped member and said first electrode, a third electrode spaced axially outwardly from said head of said first electrode and laterally to one side of, or radially of, said central axis of said head of said first electrode, said first, second and third electrodes being adapted for connection to a smoke detector circuit and said radioactive source providing a predetermined ion current flow between said first electrode and said second electrode to establish a predetermined voltage potential at said third electrode, and the voltage potential at said third electrode being changed by the presence of smoke in said space with such change in potential being sensed by the smoke detector circuit for causing an alarm to sound.

2. The smoke detector according to claim 1 wherein said cup shaped member has portions thereof along the circumferential sidewall thereof punched inwardly of said cup shaped member, said inlets providing for the entrance of ambient air into said smoke detector in a circumferential direction thereby to provide an indirect entrance for air impinging against said sidewall of said cup shaped member such that the ambient air impinging upon the peripheral sidewall of said cup shaped member is diffused into said space to minimize potential fluctuations of said third electrode when winds and drafts are present.

3. The smoke detector according to claim 1 wherein said first electrode is an elongate pin shaped electrode having said head at the end thereof.

4. The smoke detector according to claim 3 wherein said first electrode is defined by a bolt having a head forming the mounting means for mounting said radioactive source thereon.

5. The smoke detector according to claim 1 wherein said third electrode has a plate portion which lies in a plane parallel spaced from the axis of said first electrode.

6. The smoke detector according to claim 1 including a printed circuit board on which is mounted an annular insulator to which is fixed said first electrode and wherein said second electrode is supported in spaced relationship from said printed circuit board and about said first electrode by a plurality of insulating mounting members with said third electrode being positioned closer to said circuit board than to said cup-shaped member forming said second electrode to reduce noise pickup and leakage.

7. The smoke detector according to claim 6 wherein said first electrode is a bolt having a head on which is mounted said radioactive source and wherein said annular insulator is mounted on and about the shaft of said bolt, said annular insulator being fixed to said printed circuit board and said third electrode also being mounted to said annular insulator.

8. The smoke detector according to claim 7 wherein said third electrode includes a base portion which is mounted on said annular insulator and a rectangular plate portion which extends outwardly from said base portion and which lies in a plane parallel spaced from the axis of said bolt forming said first electrode.

9. The smoke detector according to claim 1 including a printed circuit board on which is mounted an insulated structure having mounted thereon said first electrode, a plurality of elongate insulated mounting members for mounting said cup shaped member on said circuit board with a rim of said cup shaped member lying in a plane parallel spaced to said circuit board and said cup shaped member being spaced from but coaxial with said first electrode and a metallic, box-shaped, electrostatic shield mounted to said circuit board and having an opening therethrough within which said cup shaped member is positioned, said electrostatic, box-shaped shield also serving to enclose the space between the rim of said cup shaped member and said printed circuit board.

* * * * *